US007748826B2

(12) United States Patent
Misumi

(10) Patent No.: US 7,748,826 B2
(45) Date of Patent: Jul. 6, 2010

(54) PRINTING HEAD AND INK JET PRINTING APPARATUS

(75) Inventor: Yoshinori Misumi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 318 days.

(21) Appl. No.: 11/854,220

(22) Filed: Sep. 12, 2007

(65) Prior Publication Data

US 2008/0259120 A1 Oct. 23, 2008

(30) Foreign Application Priority Data

Sep. 13, 2006 (JP) ..... 2006-248624

(51) Int. Cl.
*B41J 2/205* (2006.01)

(52) U.S. Cl. ..... 347/43; 347/40

(58) Field of Classification Search ..... 347/15, 347/12, 43, 40

See application file for complete search history.

(56) References Cited

U.S. PATENT DOCUMENTS

| | | | | |
|---|---|---|---|---|
| 4,528,576 | A | 7/1985 | Koumura et al. | |
| 4,593,295 | A | 6/1986 | Matsufuji et al. | |
| 6,682,170 | B2 * | 1/2004 | Hotomi et al. | 347/43 |
| 6,877,833 | B2 * | 4/2005 | Teshigawara et al. | 347/15 |
| 6,964,467 | B2 | 11/2005 | Kaneko et al. | |
| 7,118,193 | B2 | 10/2006 | Kaneko et al. | |

FOREIGN PATENT DOCUMENTS

| | | |
|---|---|---|
| JP | 58-179653 | 10/1983 |
| JP | 58-215352 | 12/1983 |
| JP | 62-264957 | 11/1987 |
| JP | 1-208143 | 8/1989 |
| JP | 9-11479 | 1/1997 |
| JP | 2001-171119 | 6/2001 |

* cited by examiner

*Primary Examiner*—Lamson D Nguyen
(74) *Attorney, Agent, or Firm*—Fitzpatrick, Cella, Harper & Scinto

(57) ABSTRACT

A printing head, having symmetrically-arranged ejection openings, can suppress deterioration in image quality as caused by manufacturing errors or problems in mounting accuracy thereof. Specifically, in the case the printing head inclines, for example, by 0.5 degrees at a line connecting corresponding ejection openings of ejection opening arrays relative to the scanning direction, deviations occur in the dots formed through one of the ejection opening arrays with reference to the dots formed through another ejection opening array. However, the deviations can be minimized by arranging adjacently small-ejection opening arrays for cyan and magenta with a spacing reduced between those ejection opening arrays.

6 Claims, 10 Drawing Sheets

SCANNING DIRECTION (FORWARD)

SCANNING DIRECTION (BACKWARD)

PRINTING HEAD AND INK JET PRINTING APPARATUS

BACKGROUND OF THE INVENTION

1. Field of the Invention

The present invention relates to a printing head and an ink jet printing apparatus and more particularly to the ejection opening arrangement in a printing head used for bidirectional printing with scanning of the printing head in two directions.

2. Description of the Related Art

For ink jet printing apparatuses such as inkjet printers, speed increase in color printing is one of the major subjects. As a technique for increasing printing speed, it is a general practice to increase the drive frequency to the printing head, to implement bidirectional printing or the like besides increasing the printing head length. Bidirectional printing is effective means as a total system in respect of cost, because of decentralization of the energy required to obtain a given throughput in terms of time. However, in bidirectional printing, the ejecting order of color inks is possibly different iii between forward and backward scans; thus a fundamental problem, in which a band-like color irregularity having a width of the scanning area occurs, is involved.

As a printing head structure for solving the above problem, Japanese Patent Laid-Open No. H1-208143 (1989) describes a structure that the ejection opening arrays for respective colors of ink are arranged in a sub-scanning direction orthogonal to the scanning direction of the printing head. Also, Japanese Patent Laid-Open No. S58-179653 (1983) describes a structure provided with ejection openings for forward printing and ejection openings for backward printing. In this document, the ejection openings or heads to be used are switched over in between forward and backward scans so that the respective colors of ink are ejected in the same order between the forward and backward scans. The printing head is structured by a combination of printing head components for ejecting respective color inks. Furthermore, Japanese Patent Laid-Open No. S58-215352 (1983) discloses a structure that the printing head is structured with a plurality of head groups to eject different colors of ink wherein the plurality of printing head groups are arranged deviated alternately in the conveying direction of a printing medium. This can increase the arrangement pitch of ejection openings in the color printing head, with respect to a desired image density.

However, in the structure as described in Japanese Patent Laid-Open No. H1-208143, the printing head has an increased length in the sub-scanning direction with a result that size increase is incurred for the apparatus. On the other hand, in the structure a plurality of printing heads are combined as described in Japanese Patent Laid-Open Nos. S58-179653 and S58-215352, the apparatus problematically increases in size in the scanning direction because of increased width of the printing head with respect to the scanning direction. Such size increase of the printing head in the scanning direction leads to increasing scanning time, thus not being desirable in the viewpoint of high-speed printing.

For the above problems, the printing head disclosed in Japanese Patent Laid-Open No. 2001-171119 arranges a plurality of ejection opening arrays for respective color inks in one body thus achieving a compact head structure. This printing head has two ejection opening arrays for each color of ink, which are separately used in forward and backward scans so that the ejecting order thereof can be identical in the forward and backward scans. The head structure is made compact by providing, in the central portion of the head, each ink supply passage commonly to the same color of ejection opening arrays for use in forward and backward printings.

In the meanwhile, concerning the structure to cope with forward and backward printings by means of a symmetric arrangement of ejection opening arrays for respective ink colors as disclosed in Japanese Patent Laid-Open Nos. S58-179653, S58-215352 and 2001-171119, there is further known a printing head structure that the symmetrically-arranged ejection opening arrays include an array of ejection openings made different in ejection opening size or in ejection volume. This allows for ejecting a small ink droplet and a large ink droplet to perform printing by ejecting the small ink droplet in the high-resolution print mode and by ejecting the large ink droplet in the high-speed print mode. However, in this printing head structure, when the large and small sized (large and small ejection volumes of) ejection openings are separately used in accordance with the print mode, there possibly encounters a problem of density unevenness due to deviation of landing positions of ejected inks resulting from the arrangement positions of the ejection opening arrays.

FIGS. 7A and 7B illustrate this problem. In the printing head shown in FIG. 7A, large-sized ejection opening arrays 21*a*, 25*b* and small-ejection opening arrays 21*b*, 25*a* are provided, for example for cyan (C1, C2) ink. A set of a large-ejection opening array 21*a* and a small-ejection opening array 21*b* and a set of a small-ejection opening array 25*a* and a large-ejection opening array 25*b* are arranged symmetric with each other. In this printing head structure, printing is made by using only the small-ejection opening arrays 21*b*, 25*a* as to cyan ink in the high resolution mode or so. In this case, there encounters a possible case that the ejection opening array 25*a* is wholly in a positional relationship inclining upward or downward relative to the ejection opening array 21*b* with respect to the scanning direction (in the left-right directions in the figure), due to the error in mounting the printing head or so. In the figure, illustrated is an example showing inclining θ upward. Particularly in the printing head structured such that ejection opening arrays for respective colors are integrated as described in Japanese Patent Laid-Open No. 2001-171119, inclination relationship as above arises where there are assembly tolerances of the printing head or mounting errors on the printer body. In such a case, the cyan ink ejected from the ejection opening array 25*a* lands at a position wholly deviated upward or downward from the normal position, relative to the landing position of the cyan ink ejected from the ejection opening array 21*b*. As a result, overlaps and gaps arise between the dots thus formed as shown in FIG. 7B, which causes density unevenness such as stripes in a printed image.

Such problems arise likewise in the mode using the large-ejection opening arrays. However, the large-sized dot, even if it deviates from the normal position, causes less change of density on the whole because of its comparatively greater area as represented on the printing medium. Namely, where forming a dot smaller in size, density change becomes more conspicuous due to gaps and overlaps of dots, which in turn appears in the form of density unevenness. In addition, the ink, whose spacing is greater in its symmetric arrangement, appears more conspicuous with respect to density. In the example of FIGS. 7A and 7B, overlaps or gaps of dots are more conspicuous as to ink C1, C2 than as to ink M1, M2. More specifically, provided that a dot-to-dot distance is "d" as to the same color ink, deviation is related to d sin θ, thus meaning that overlaps or gaps of dots increase commensurate with the distance "d".

As described so far, where using a printing head having sets of large-sized (large ejection volume of) ejection openings and small-sized (small ejection volume of) ejection openings for ink of the same color wherein two sets thereof are arranged symmetric with each other, the problem of density unevenness may be possibly encountered due to the manufacture errors of the printing head, depending on a certain print mode or so.

SUMMARY OF THE INVENTION

An object of the present invention is to provide a printing head and an ink jet printing apparatus which is capable of suppressing the deterioration of image quality as caused by the manufacturing error or problems in mounting accuracy of the printing head having ejection openings arranged symmetrical.

In a first aspect of the present invention, there is provided a printing head that is structured for including ejection opening-array groups, which is made up by a plurality of ejection opening arrays from which inks of a same color and of a same volume are ejected, for each color and volume of ink to be ejected, wherein the plurality of ejection opening arrays in each of a first ejection opening-array group and a second ejection opening-array group from which ink of a same color as and of larger volume than ink from the first ejection opening-array group is ejected, of a plurality of ejection opening-array groups, are arranged adjacent to one another.

In a second aspect of the present invention, there is provided an ink jet printing apparatus for performing printing by using a printing head, which is structured for including ejection opening-array groups, which is made up by a plurality of ejection opening arrays from which inks of a same color and of a same volume are ejected, for each color and volume of ink to be ejected, and in which the plurality of ejection opening arrays in each of a first ejection opening-array group and a second ejection opening-array group from which ink of a same color as and of larger volume than ink from the first ejection opening-array group is ejected, of a plurality of ejection opening-array groups, are arranged adjacent to one another, to eject ink to a printing medium, said apparatus comprising: print control means for executing printing operations of a plurality of print modes, wherein said print control means executes the printing operation of the print mode in which the ejection opening-array group from which ink of relatively small volume is ejected is only used, of the plurality of ejection opening-array groups.

According to the above structure, ejection opening-array groups, ejection openings of which are equal in ejection volume, are arranged adjacent to each other. This allows, even where deviation arises in the dots formed through the ejection openings of the plurality of ejection opening-array groups due to an inclination of the printing head, the deviation to be in such a slight amount as not to be visually recognized on the print image, because of a small spacing between the plurality of ejection opening-array groups.

As a result, image quality can be prevented from deteriorating due to manufacturing errors or problems in mounting accuracy of the printing head having a plurality of ejection opening-array groups arranged symmetric but different in ejection volume at the ejection openings thereof for a plurality of print modes based on forward and backward printings.

Further features of the present invention will become apparent from the following description of exemplary embodiments with reference to the attached drawings.

DESCRIPTION OF THE EMBODIMENTS

With reference to the drawings, embodiments of the present invention will now be described in detail.

Note that, in the specification, the term "printing medium" broadly means those capable of accepting ink, e.g. cloths, plastic films or metal sheets, without being limited to paper for use in an ordinary printer. Meanwhile, the term "ink" signifies a liquid for forming an image, a design or a pattern or for processing of a printing medium by being provided onto the printing medium.

First Embodiment

Figure 1A:
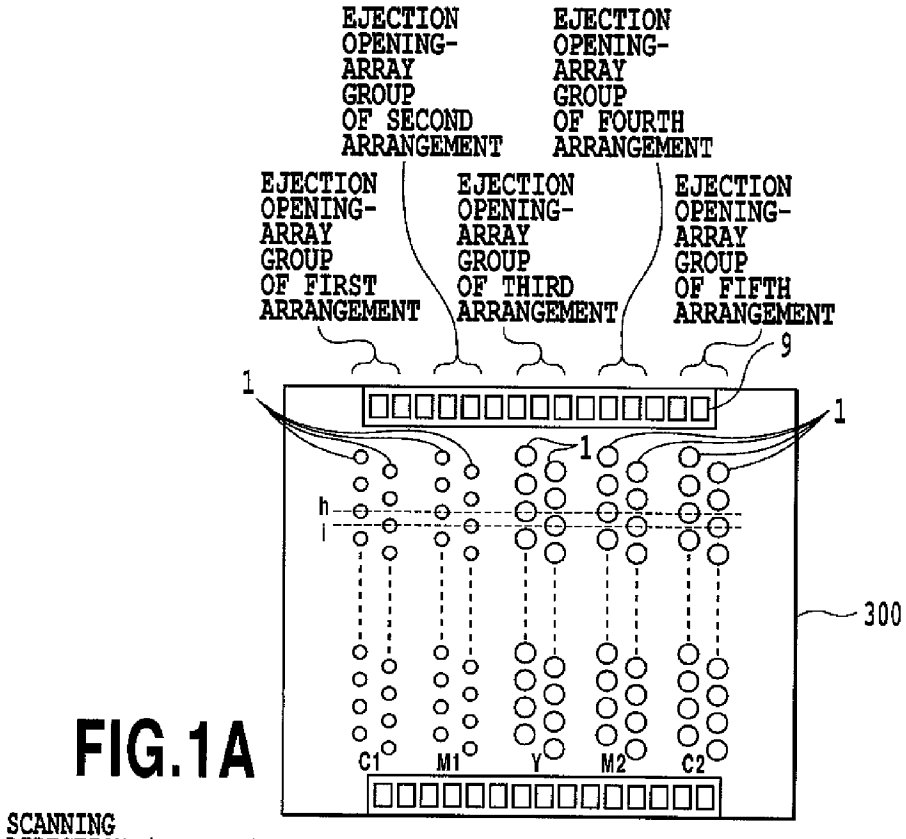
FIGS. 1A to 1C are views explaining a printing head according to a first embodiment of the present invention.
Figure 1C:
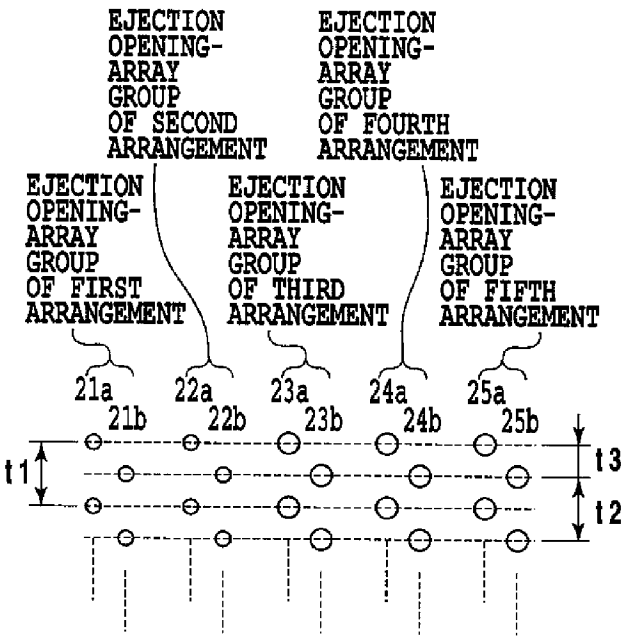
Figure 1B:
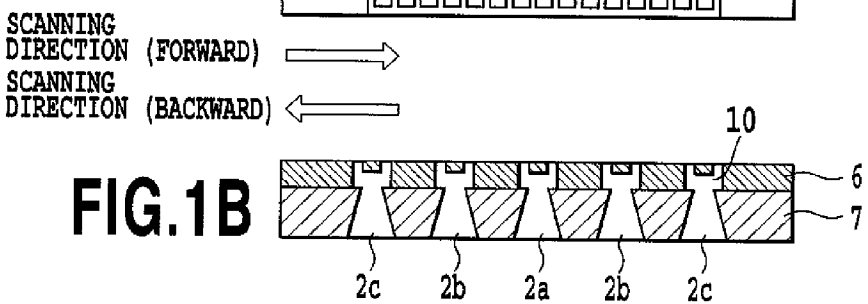

FIGS. 1A-1C are views typically showing an essential part of a printing head according to a first embodiment of the present invention. FIG. 1A is a front view showing a face of the printing head where ejection openings are arranged, FIG. 1B is a sectional view taken along a plane where ejection openings are arranged, and FIG. 1C is an explanatory view for explaining the arrangement of the ejection openings.

As shown in FIG. 1B, the printing head 300 of the embodiment roughly includes a substrate 7 provided with electro-thermal convening elements serving as energy generating elements for use in ejecting ink, and an orifice plate 6 in which ejection openings 1 are formed. The substrate 7, in the embodiment, is formed of a silicon single crystal having a planar orientation <100>. Over the surface of the substrate 7, there are electro-thermal converting elements, a drive circuit having transistors, etc., for driving those elements, contact pads 9 for connection to a wiring board (referred to later), and wiring lines connecting between the drive circuit and the contact pads 9, which are formed through a semiconductor process. In the substrate 7, five through-holes are formed by anistropic etching in an area other than the area arranging the foregoing drive circuit, etc. Those through-holes each form ink supply ports 2*a*, 2*b* (two), 2*c* (two) through which ink is supplied to ejection opening arrays 21*a*, 21*b*-25*a*, 25*b* (referred to later). The central ink supply port 2*a* serves as a common port through which ink is to be supplied to an ejection opening-array group of third arrangement having two arrays for yellow (Y). Namely, the printing head of this embodiment is structured with such ejection opening arrays for inks of respective colors as disclosed in Japanese Patent Laid-Open No. 2001-171119, in one body. Note that FIG. 1A typically illustrates a state that the orifice plate 6 is laid upon a substrate 7 wherein the ink supply ports are not shown. In this embodiment, the orifice plate 6, arranged on the substrate, is formed of a photosensitive epoxy resin and formed with ejection openings 1 and passages 10 correspondingly to the electro-thermal converting elements by use of a process described, for example, in Japanese Patent laid-Open No. S62-264957. In this case, a silicon oxide or nitride film is formed over the silicon substrate as described in Japanese Patent Laid-Open No. H9-11479 (1997). Then, an orifice plate is formed which has through-holes, ejection openings and passages, followed by removing the silicon oxide or nitride film in areas corresponding to ink supply ports. This is desirable because an inkjet head is to be fabricated with precision at low cost.

Figure 2:
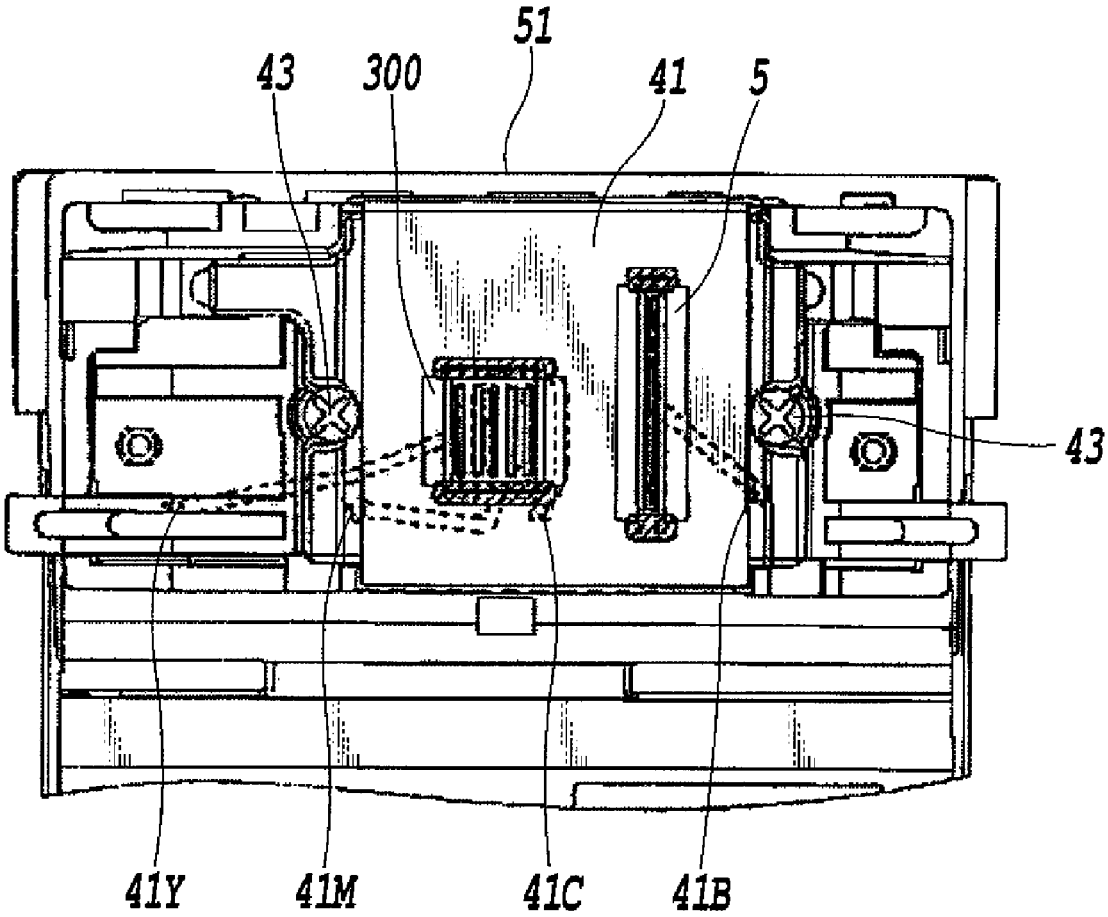
FIG. 2 is an explanatory view for explaining an example of a printing head cartridge mounting thereon the printing head according to the embodiment of the invention.

For the printing head 300 having the substrate 7 and the orifice plate 6 as described above, thermal energy is supplied to ink by the electro-thermal converting elements, and film boiling caused by the supplied thermal energy generates a bubble. Then, by utilizing the pressure of the bubble, ink is ejected through the ejection openings 1. The printing head 300 is attached on an ink-passage forming member 41 that is in communication with the ink supply ports as shown in FIG. 2, and the contact pads 9 of the printing head are connected to a wiring board. This allows the electric connector 51 provided on the wiring board to be placed in connection with the electric connection by attaching the printing head onto the printer, thus being allowed to receive a drive signal, etc. from the printer.

Figure 3:
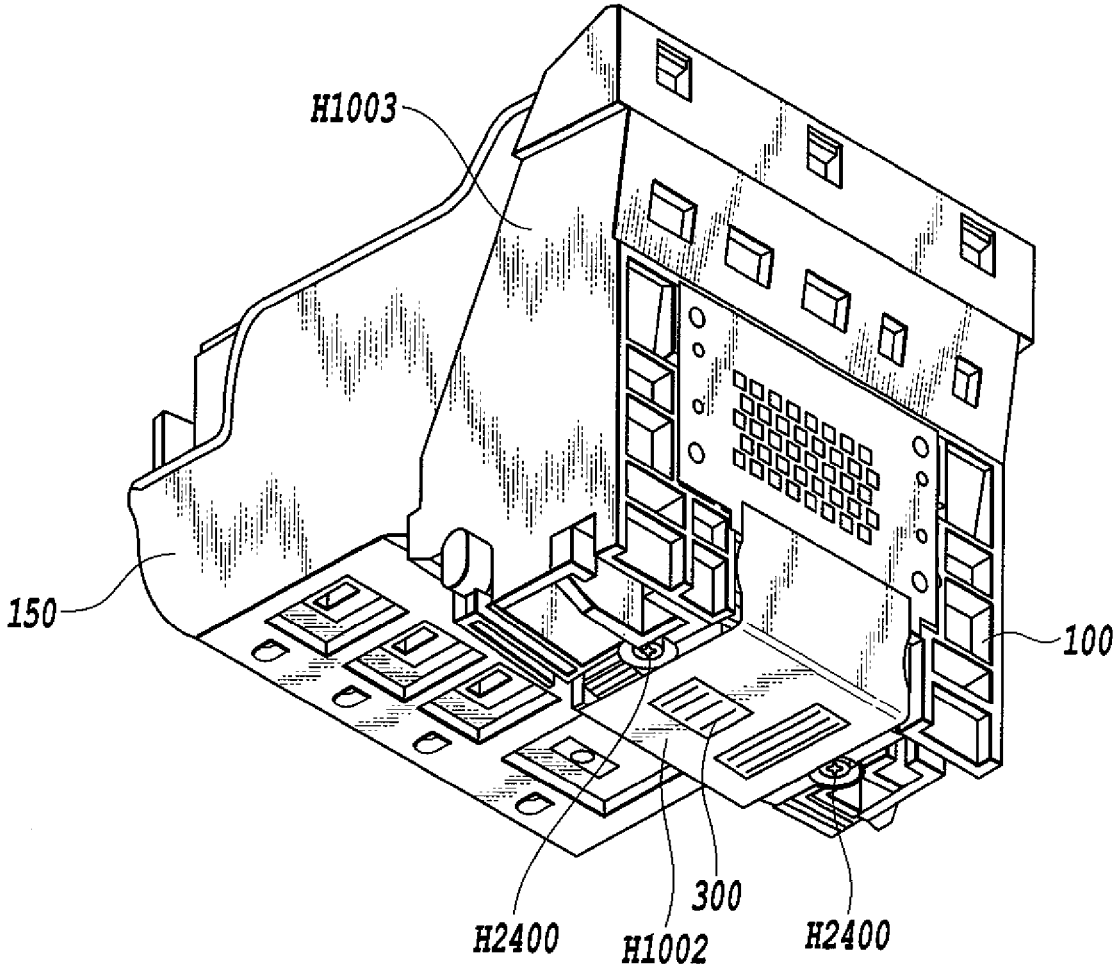
FIG. 3 is an explanatory view showing the printing head cartridge according to the embodiment of the invention.
Figure 4:
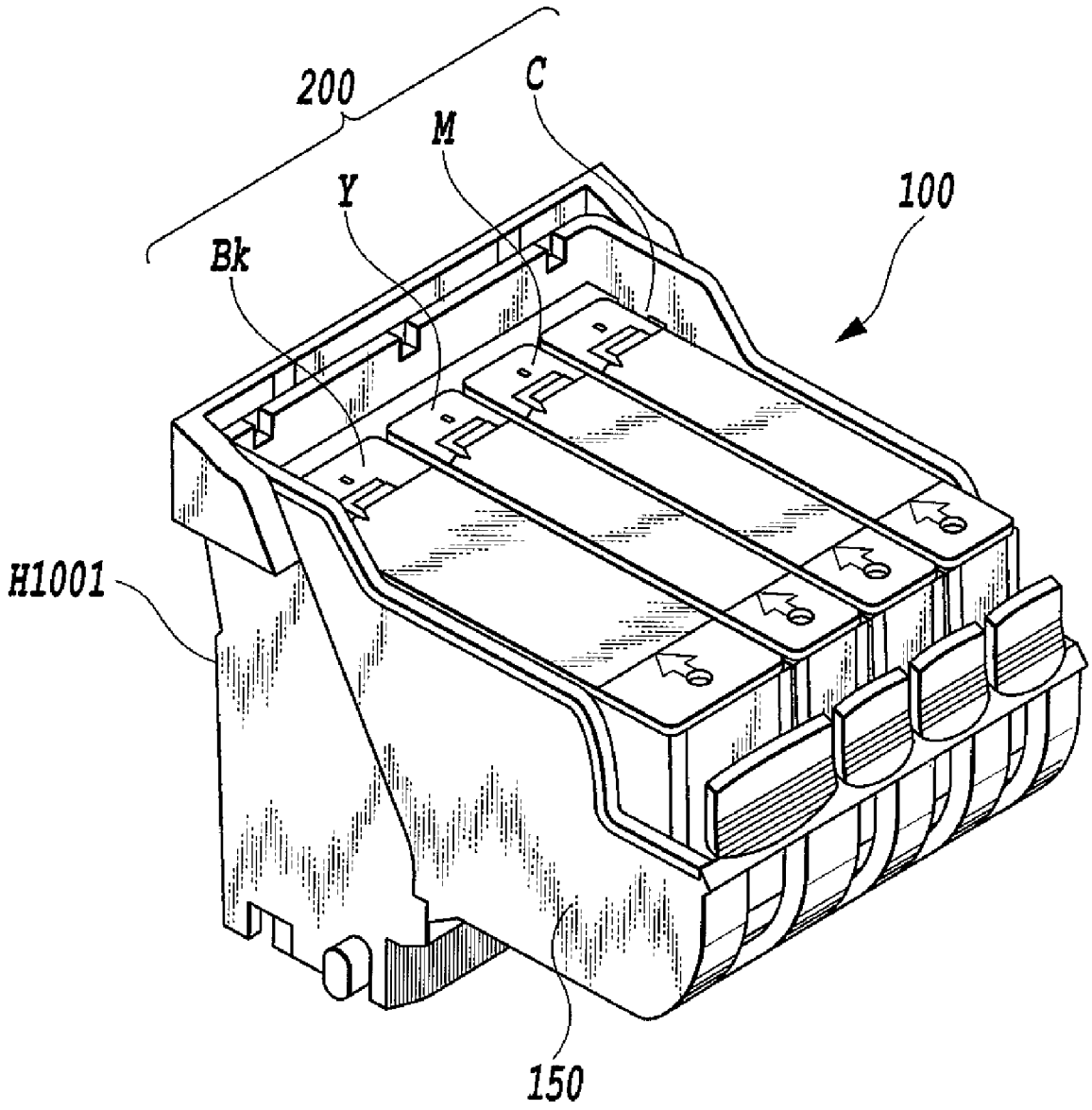
FIG. 4 is an explanatory view showing the printing head cartridge according to the embodiment of the invention.

FIG. 3 is a perspective view exemplifying a printing head cartridge 100 having the printing head 300 according to the embodiment. The printing head cartridge has a tank holder 150 for holding an ink tank 200 (200Y, 200M, 200C) storing therein the ink to be supplied through the ink-passage forming member, as shown in FIG. 4.

In the printing head of the embodiment, an ejection opening-array group of first arrangement and an ejection opening-array group of fifth arrangement are arranged symmetrically for cyan (C1, C2) ink, as shown in FIGS. 1A and 1C. Likewise, an ejection opening-array group of second arrangement and an ejection opening-array group of fourth arrangement are arranged symmetrically for magenta (M1, M2) ink. Then, as for cyan ink, the ejection opening-array group of first arrangement arranges only small-sized ejection openings while the ejection opening-array group of fifth arrangement arranges only large-sized ejection openings. This is true for magenta ink, i.e., the ejection opening-array group of second arrangement arranges only small-sized ejection openings while the ejection opening-array group of fourth arrangement arranges only large-sized ejection openings. Here, the large-sized ejection opening has an ejection volume of 4 pl while the small-sized ejection opening has an ejection volume of 1 pl. For yellow (Y) ink, one ejection opening-array group in which only large-sized ejection openings are arranged is positioned at a center of the above symmetric arrangement.

In each of the ejection opening-array groups of first to fifth arrangements, ejection openings are arranged in a zigzag form. More specifically, each ejection opening-array group has two arrays, each of which arranges ejection openings at a pitch t1 (=t2), and which are arranged deviated by a half (t3) of the pitch t1 from each other. Namely, the ejection opening-array groups of first to fifth arrangements include ejection opening arrays 21*a*, 21*b*, ejection opening arrays 22*a*, 22*b*, ejection opening arrays 23*a*, 23*b* ejection opening arrays 24*a*, 24*b* and ejection opening arrays 25*a*, 25*b*, as shown in FIG. 1C.

Specifically, the ejection opening-array groups of first to fifth arrangements are each formed with arrays "a" and "b" of ejection openings that are arranged substantially vertically to the scan direction of the printing head. In this embodiment, the arrays "a" and "b" forming the ejection opening-array groups of first to fifth arrangements are each arranged with 128 ejection openings at a pitch of t1=t2 approximately 42 μm (1/600 inch).

Here, in FIG. 1A, the line connecting between the h-th ejection openings on the respective arrays "a" of the groups and the line connecting between the i-th ejection openings on the respective arrays "b" have the same direction as the scanning direction, as shown in FIG. 1A. In this manner, the ejection opening arrays 21*a*-25*b* in the embodiment are arranged so that the corresponding ejection openings are identical in position with respect to the scanning direction in which the printing head mounted on a printing apparatus, described later, or the like scans. This allows for color printing by forming color inks of dots, for a pixel in the same position.

The printing apparatus of the embodiment can perform printing in any of two modes: a high-speed mode with one-pass and bidirectional printing on a plain paper (hereinafter, referred merely to as a high-speed mode) and a high-resolution mode.

Figures 5A, 5B, 5C:
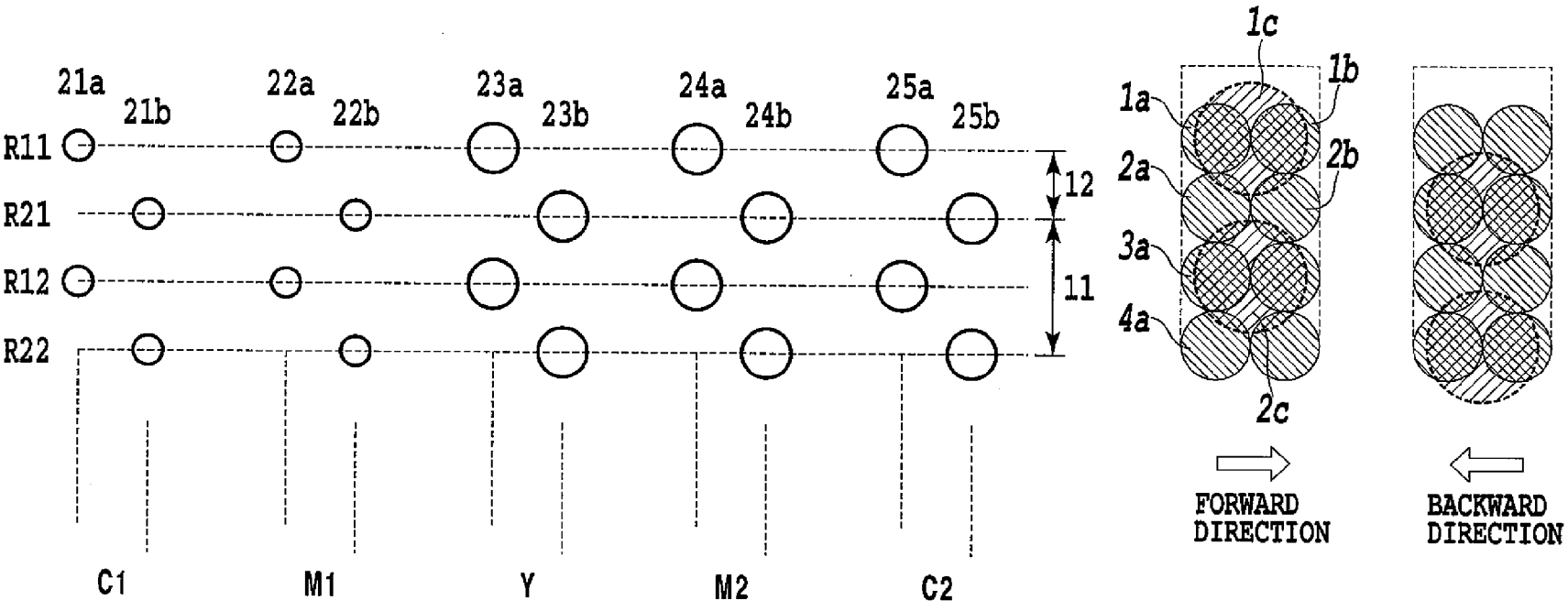
FIGS. 5A to 5C are diagrams explaining a printing method in a high-speed print mode based on forward and backward printings, using the printing head according to the first embodiment of the invention.

FIGS. 5A-5C are diagrams illustrating an operation in the high-speed mode. In the high speed mode, resolution is taken at 600 pixels per inch (600 dpi) in both the main and sub scanning directions. This can reduce the time of image processing and data transfer. Meanwhile, ink of volume approximately at 8 pl is ejected per one pixel.

FIGS. 5B and 5C show a case that cyan and magenta dots are printed in the same position in a bidirectional printing. In a forward printing shown in FIG. 5B, printing for one pixel is made as a set of one dot (1*c*) formed with a volume of 4 pl through the ejection opening corresponding to a raster R11 and two dots (1*a* and 1*b*, 2*a* and 2*b*) each formed with a volume of 1 pl through the ejection opening corresponding to rasters R11, R21. In a backward printing, printing for one pixel is made as a set of two dots each formed with a volume of 1 pl through the ejection opening corresponding to rasters R11, R21 and one dot formed with a volume of 4 pl through the ejection opening corresponding to a raster R21. In this manner, one pixel is formed through the ejection openings corresponding to two rasters (R(n−1)1, R(n−1)2). Here, since the ejection openings have a pitch 11 of approximately 42 μm (1/600 in.) wherein the ejection opening arrays "a" and "b" are deviated by a half pitch from each other in the sub scanning direction, the distance 12 between adjacent rasters is provided as approximately 21 μm (1/1200 in.).

Now consider the case that printing is made in the primary color, e.g., in a cyan single color. In the forward printing, one droplet of 4 pl is ejected from the ejection opening array 25*a* and then four droplets of 1 pl are ejected from the ejection opening arrays 21*a*, 21*b* in a manner overlapping the dot of 4 pl. In the backward printing, four ink droplets each in a volume of 1 pl are ejected from the ejection opening of the ejection opening arrays 21*a*, 21*b*, and then one droplet in a volume of 4 pl is ejected from the ejection opening of the ejection opening away 25*b* in a manner overlapping the dots of 1 pl.

In the case of a secondary color, printing similar to the primary color case is performed for two colors. When printing a blue image, one or four droplets of ink are ejected, for one pixel, from the arrays of the ejection opening-array group of first arrangement 21*a*, 21*b* for cyan, the ejection opening-array group of second arrangement 21*a*, 22*b* for magenta, the ejection opening-array group of fourth arrangement 24*a*, 24*b* for magenta and the ejection opening-array group of fifth arrangement 25*a*, 25*b* for cyan. In the forward printing, since the ejection opening-arrays pass a predetermined pixel on the printing medium in the order of C2→M2→M1→C1, inks land at the predetermined pixel in the order of cyan, magenta, magenta and cyan one over another. In the backward printing, since the ejection opening-arrays pass a predetermined pixel on the printing medium in the order of C1→M1→M2→C2, inks land at the pixel in the order of cyan, magenta, magenta and cyan one over another. In this manner, the landing order of colors is identical between the forward and the backward printings. Even in bidirectional printing, a uniform blue image can be printed without encountering the variation of color or density between the scanning areas.

As for the ejection volume to one pixel in the high-speed mode, in the forward printing, one droplet of cyan ink is ejected from the ejection opening away 25*a* and one droplet of magenta ink is ejected from the ejection opening array 24*a* while two droplets of magenta ink are ejected from the ejection opening arrays 22*b*, 22*a* and two droplets of cyan ink are ejected from the ejection opening arrays 21*b*, 21*a*. In the backward printing, two droplets of cyan ink are ejected from the ejection opening arrays 21*a*, 21*b* and two droplets of magenta ink are ejected from the ejection opening arrays 22*a*, 22*b* while one droplet of magenta ink is ejected from the ejection opening array 24*b* and one droplet of cyan ink is ejected from the ejection opening array 25*b*. In this case, ejection frequency is 30 KHz at the ejection opening arrays of C1, M1 while ejection frequency is 15 KHz at the ejection opening arrays of M2, C2.

Now explanation is made on the high resolution mode. In this mode, printing is made for each pixel at a resolution of 2400 pixels per inch with respect to the scanning direction and at a resolution of 1200 pixels per inch with respect to the sub-scanning direction. When printing is made for cyan or magenta, one droplet is ejected for one pixel. Meanwhile when printing is made for yellow, one droplet is ejected for two pixels. In this case, printing data is masked to perform printing at the ejection opening arrays C1, M1 and Y. Namely, for cyan and magenta, printing is made by use of only the ejection opening-array groups of first and second arrangements that are smaller in ejection opening size. Since those are in a zigzag arrangement of ejection openings at an arrangement density of 600 openings per inch, pixels can be formed at a density of 1200 pixels per inch with respect to the sub-scanning direction.

When using the printing head of this embodiment, in the case of printing a blue image for example by bidirectional printing in the high resolution mode, two types of pixels, i.e., the pixel printed in the order of C1→M1 (cyan predominant in coloring) and the pixel printed in the order of M1→C1 (magenta predominant in coloring) are mixed. However, both can be arranged equivalent by use of a suitable mask. In addition, color irregularity can be less perceived by performing bidirectional printing in a multi-pass printing scheme such as of two or four passes.

Figure 6B:
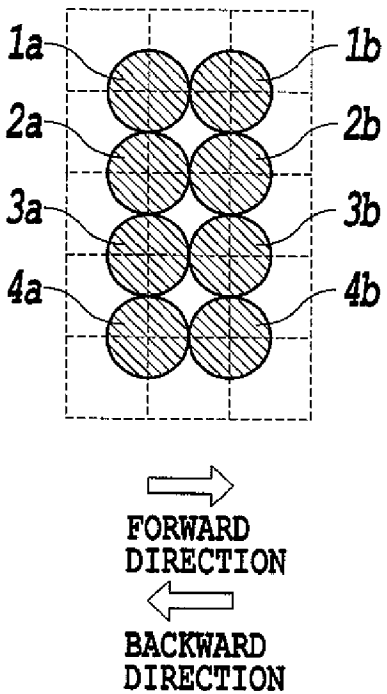
FIGS. 6A and 6B are diagrams explaining a printing method in a high-resolution mode based on forward and backward printings, using the printing head according to the first embodiment of the invention.
Figure 6A:
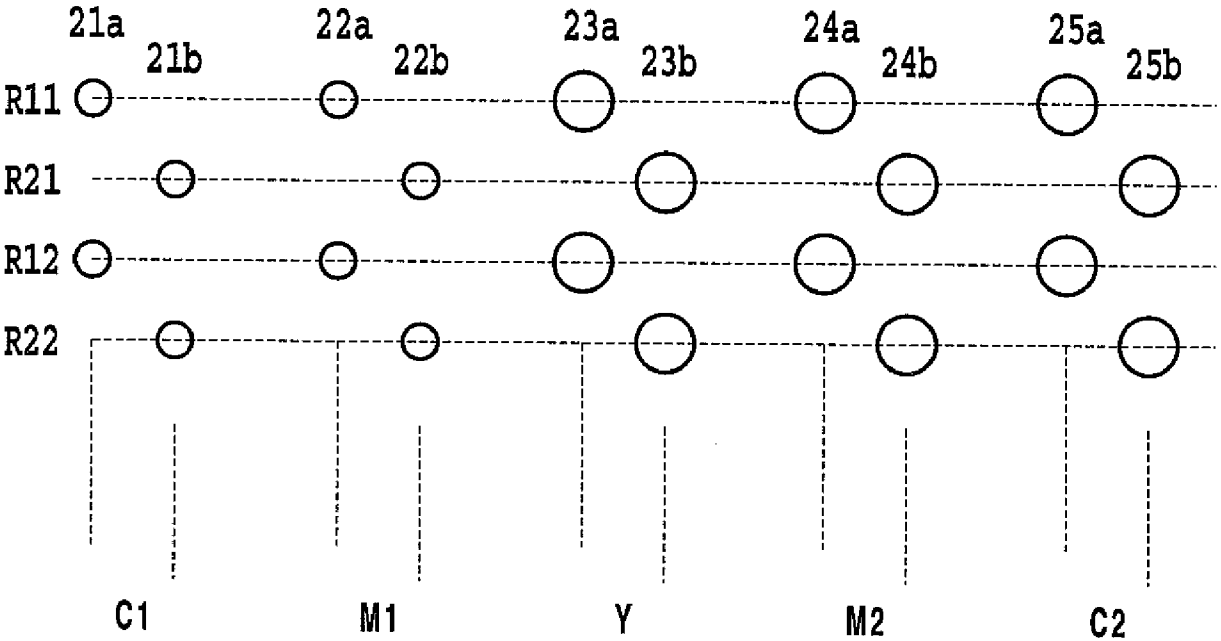

FIGS. 6A and 6B are diagrams showing the dots formed where a blue image is printed in the secondary-color high resolution mode by use of the printing head according to the present embodiment. For a raster R11, ink is ejected to each pixel at a rate of one droplet per two pixels from ejection opening array 21*a* of the ejection opening-array group of first arrangement and the ejection opening array 22*a* of the ejection opening-array group of second arrangement. Meanwhile, for a raster R21, ink is ejected at a rate of one droplet per two pixels from the ejection opening array 21*b* of the ejection opening-array group of first arrangement and the ejection opening array 22*b* of the ejection opening-array group of second arrangement, thereby forming a blue image. As for ideal landing of the dots, overlapped dots of cyan and magenta are in a regular arrangement at an interval of 1200 dpi horizontally and vertically, as shown in FIG. 6.

However, there is a possibility of positional deviation from the ideal landing points because of errors in the manufacture of a printing head, errors caused upon mounting on a printing apparatus and so on.

Figure 7B:
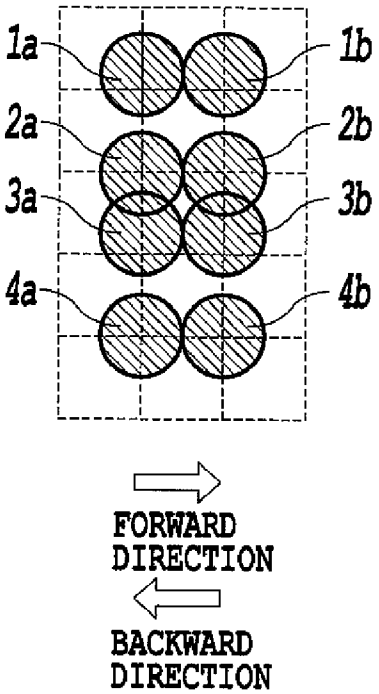
FIGS. 7A and 7B are diagrams explaining the density unevenness caused in the high-resolution mode based on forward and backward printings, using the existing head.
Figure 7A:
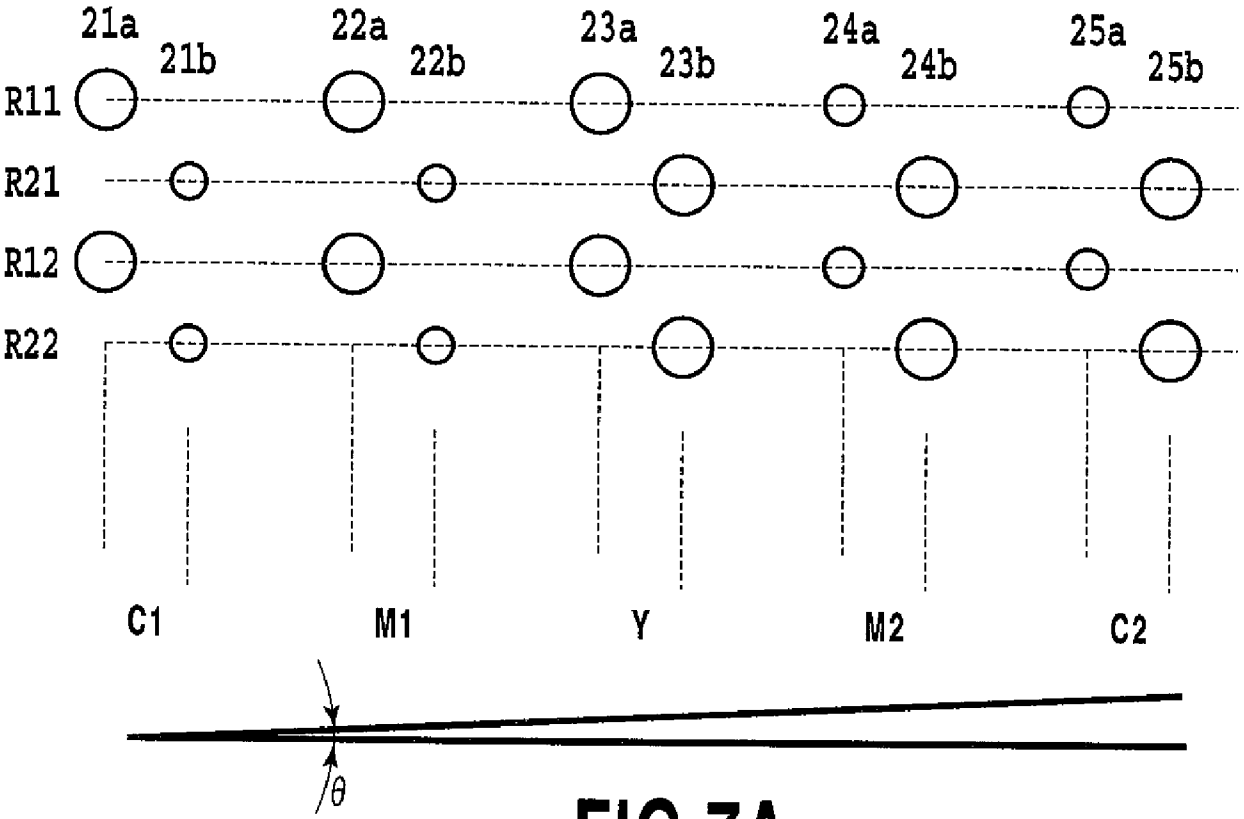

FIGS. 7A and 7B show printing of a blue-image in the high resolution mode where there is a inclination, for example, of 0.5 degrees (θ=0.5 degree) of the line connecting the corresponding ejection openings between the ejection opening-array groups, relative to the scanning direction, in the foregoing conventional printing head structure. In the high resolution mode using the printing head structure shown in FIG. 7A, dots are formed by ejecting ink to each pixel at a 1200 dpi×2400 dpi from the ejection opening arrays 21*b*, 22*b*, 24*a*, 25*a*. In this case, if a dot with the ejection opening array 21*b* is set as a reference, the magenta dot with the ejection opening array 22*b* is formed in a position deviated by 1.2 μm, the magenta dot with the ejection opening array 24*a* is in a position deviated by 3.4 μm, and the cyan dot with the ejection opening array 25*a* is in a position deviated 4.6 μm. As a result, the dots are caused with a partial overlap of and a gap between dots, thus resulting in a stripe like density unevenness perceived upon viewing the printed image. In this manner, in the conventional printing head structure, slight errors in the manufacture may possibly lead to an effect upon the image thus incurring quality deterioration.

Figure 8B:
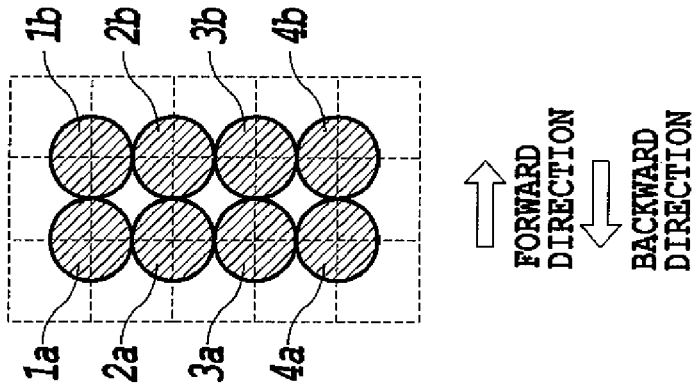
FIGS. 8A and 8B are diagrams explaining the reduction of a density unevenness caused in the high-resolution mode based on forward and backward printings, using the printing head according to the first embodiment of the invention.
Figure 8A:
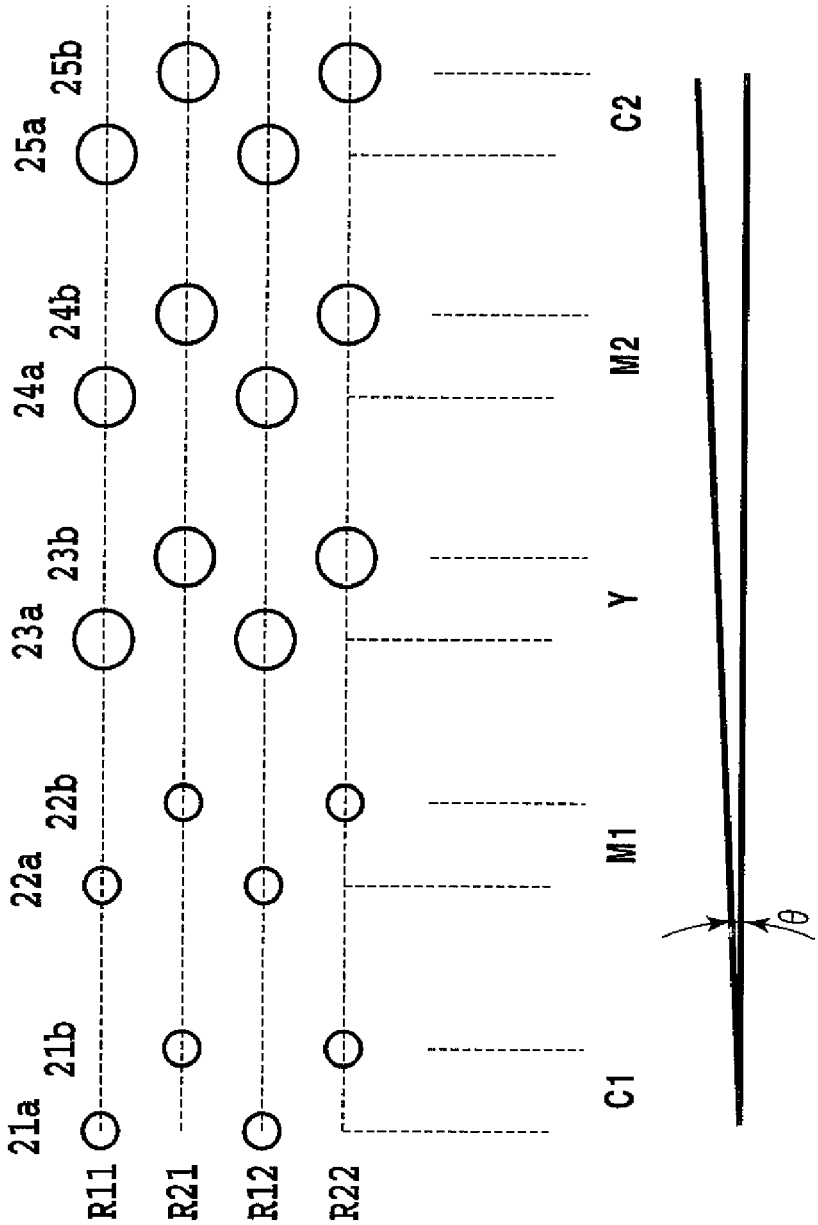

On the other hand, FIGS. 8A and 8B are diagrams illustrating printing of a blue image in the high resolution mode by means of the printing head structure of the present embodiment. Like the above, there is shown a case that there is an inclination, for example, of 0.5 degrees (θ=0.5 degree) of the line connecting the corresponding ejection openings between ejection opening-array groups, relative to the scanning direction, in the state that the printing head is mounted on the printer body.

In this head structure, a blue image is printed by ejecting ink to each pixel at a 1200 dpi×2400 dpi resolution from the ejection opening arrays 21*a*, 21*b*, 22*a*, 22*b*. In this case, if a dot with the ejection opening away 21*a* is set as a reference, the cyan dot with the ejection opening away 21*b* deviates 0.2 μm, the magenta dot with the ejection opening away 22*a* deviates 1.2 μm, and the magenta dot with the ejection opening away 22*b* deviates 1.4 μm. However, the deviations are such deviations as not changed in dot formed position from the normal as shown in FIG. 8B, and thus the stripe like density unevenness is less or not visually recognized on the actually printed image. More specifically, in the embodiment, the small-sized ejection opening-array groups for cyan and magenta are arranged adjacent to each other and made smaller in the distance between these ejection opening-array groups. This allows, even in the case where an inclination as above occurs, the deviation in dot formed position caused by the effect thereof to be minimized.

It should be noted that the above printing method is a mere one scheme for performing a bidirectional printing by use of the printing head to which the invention is applied. It is natural that the foregoing two print modes are not limitative. The invention can exhibit the effect for the printing head used in forming an image in the different overlapping order of at least two types of liquids in order to decrease color irregularity. Meanwhile, the foregoing embodiment was exemplified with cyan, magenta and yellow inks as ink types to lay one over another, which however is not limitative. For example, the inks may include lighter color inks. Besides, the liquid types of green, blue, red, etc. to lay one over another, may be of a combination of other colors.

Meanwhile, the embodiment was structured with the ejection opening-array groups of first to fifth arrangements in a common orifice plate or with the energy converting elements, for ejecting droplets at the ejection openings in the ejection opening-array groups of first to fifth arrangements, on a common substrate. Alternatively, the invention is to be applied even to a structure that the ejection opening-array group of first arrangement and the ejection opening-array groups of second to fifth arrangements are provided in separate printing heads so that those can be assembled together into a head unit. Nevertheless, the structure as in the embodiment is desirable in that there is no need to align between the ejection opening arrays of the printing head.

Second Embodiment

Figure 9C:
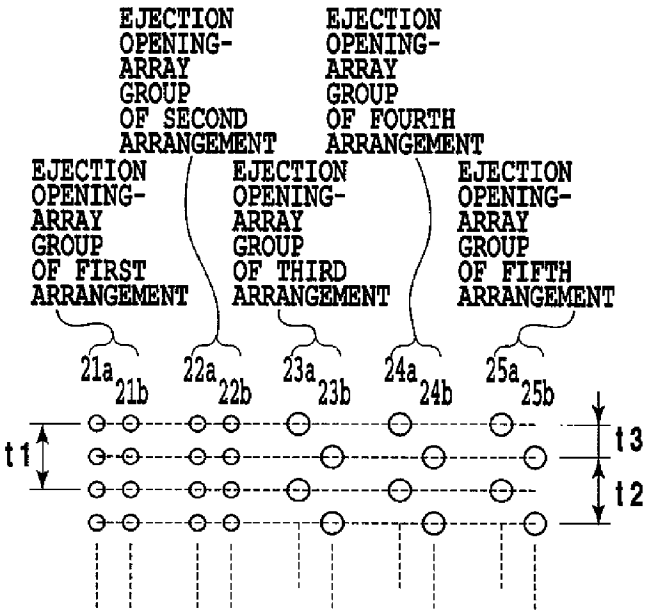
FIGS. 9A to 9C are explanatory views showing a printing head according to a second embodiment of the present invention.
Figure 9A:
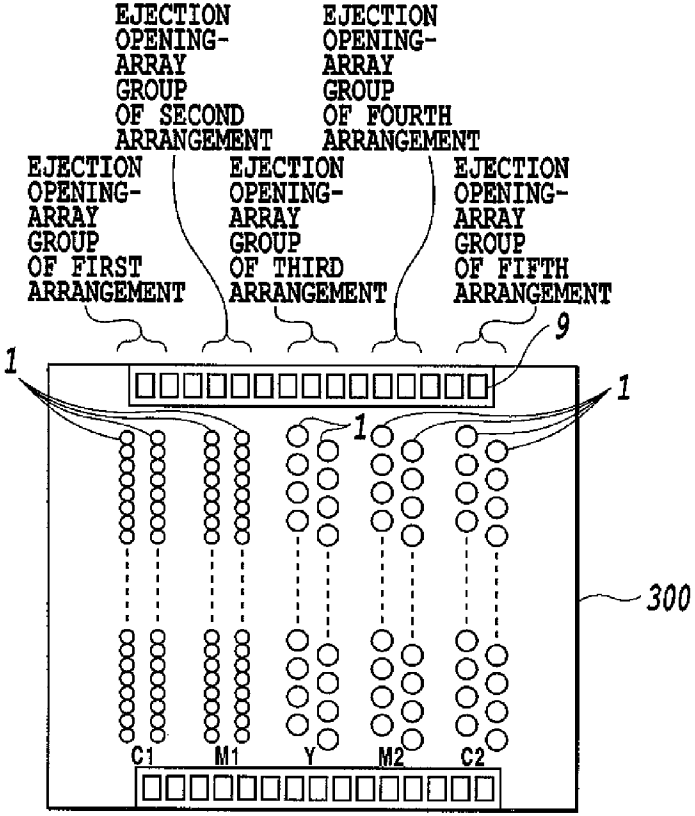
Figure 9B:
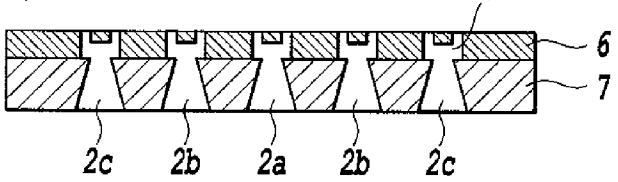

FIGS. 9A-9C are diagrams illustrating a printing head according to a second embodiment of the present invention, shown in a similar manner as FIGS. 1A-1C of the first embodiment. In FIGS. 9A-9C, elements like in function is assigned like reference numerals, and detailed explanation thereof is omitted.

In FIG. 9A-9C, the ejection opening-array groups of first to fifth arrangements are each formed with ejection opening arrays "a" and "b" that are arranged substantially vertical to the scanning direction.

In this embodiment, the ejection opening arrays "a" and "b" forming the ejection opening-array groups of first and second arrangements are each arranged with 256 ejection openings at a pitch of t3=approximately 21 μm (1/1200 inch). The two arrays of each of these ejection opening-array groups have small-sized ejection openings that are arranged identical in position in the sub-scan direction.

The ejection opening arrays "a" and "b", forming the ejection opening-array groups of third to fifth arrangements, are each formed with 128 ejection openings at a pitch of t1=approximately 42 μm (1/600 inch). The ejection opening array "a" and the ejection opening array are arranged deviated by just a half pitch (t3=t1/2 approximately 21 μm) of ejection opening arrangement, in the sub-scanning direction of the printing head (i.e., coincident with the direction of the ejection opening array, in this embodiment). Meanwhile, each of the ejection opening arrays is arranged with large-sized ejection openings.

As described above, the difference from the first embodiment lies in that the ejection opening-array groups of first and second arrangement have ejection openings arranged at a pitch of half of that shown in the first embodiment. This embodiment is similar in a printing method to the first embodiment, and thus ink-ejection drive frequency can be set at 15 KHz as to all the ejection openings of the ejection opening-array groups of first to fifth arrangement. More specifically, the ejection openings of the two arrays "a" and "b", of the ejection opening-array group of first or second arrangement, can be used in forming two small dots arranged in the scanning direction as shown in FIGS. 5B, 5C and 6B. This can halve the drive frequencies for those as compared to the first embodiment structure.

In the above embodiment, the distance between the ejection opening-array groups of first and second arrangements that are comparatively less in ejection volume is given smaller as compared to the distances between the opening-array group of first arrangement and the respective ejection opening-array groups of third, fourth and fifth arrangements comparatively larger in ejection volume. This can suppress the effect of head inclination.

In this embodiment, by suppressing the effect of manufacturing errors to the minimal degree as compared to the existing printing head structure, printing of high image quality is possible owing to stable ejection of ink.

Figure 10:
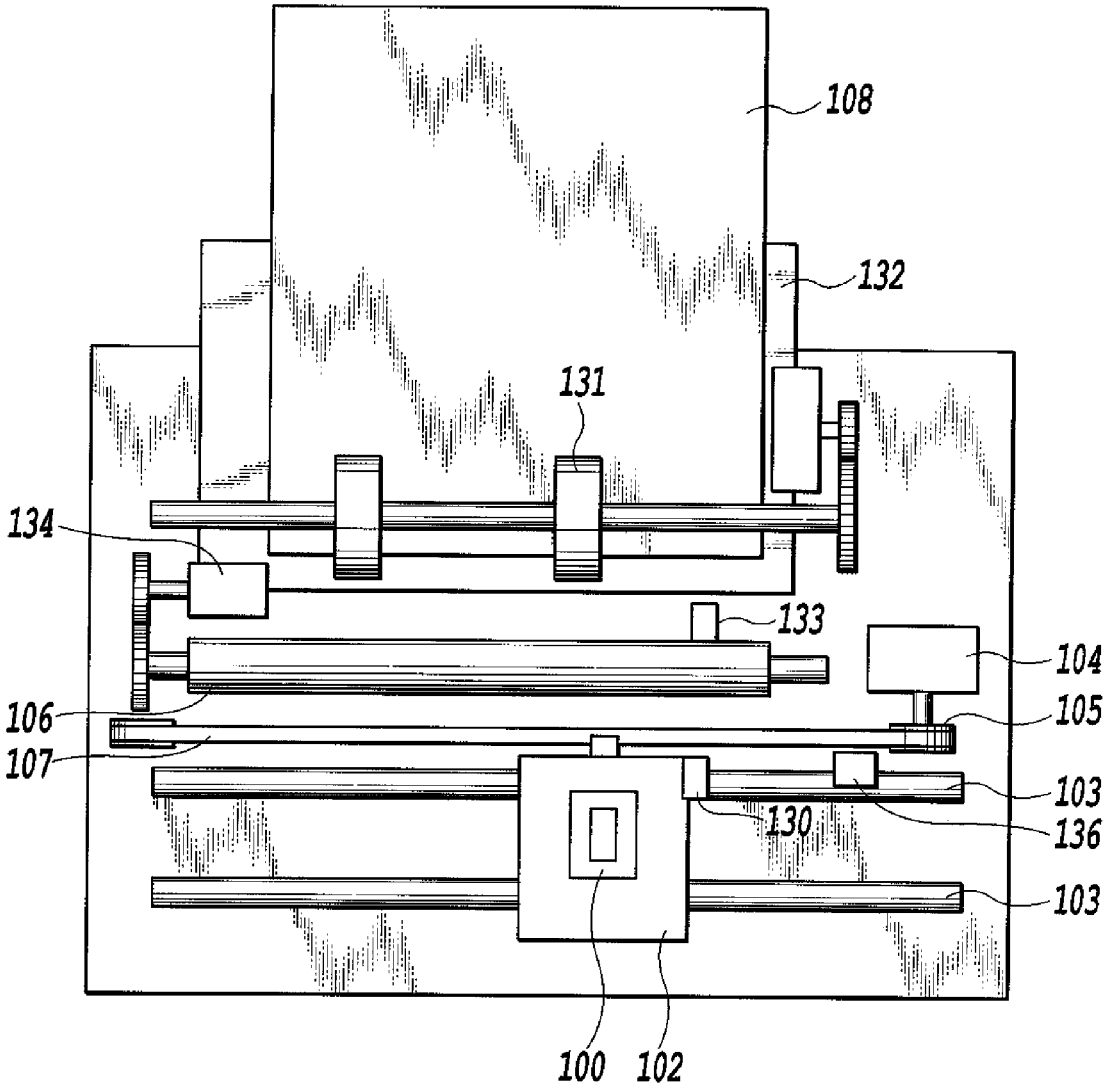
FIG. 10 is an explanatory view showing an example of a printer capable of mounting thereon the printing head according to the invention.

FIG. 10 shows a schematic structure of an ink jet printing apparatus capable of mounting a printing head thereon according to any of the above described embodiments.

In FIG. 10, the head cartridge 100 which the printing head explained in the embodiment is integrated with an ink tank is to be removably mounted on the carriage 102. The head cartridge 100 and the carriage 102 are electrically connected with each other through a connector through which signals are to be exchanged for ink-ejection driving at the printing head.

The carriage 102 is supported for reciprocation over a guide shaft 103 arranged extending in the main scanning direction in the apparatus body. The carriage 102 is to be driven and controlled in position and movement by a main scanning motor 104 through a drive mechanism, such as a motor pulley 105, a driven pulley 106 and a timing belt 107. Meanwhile, a home position sensor 130 is provided on the carriage. Due to this, the position of a shield plate 136 can be known when the home-position sensor 130 on the carriage 102 passes through.

The printing medium 108, such as a paper or plastic sheet, is fed one by one from an auto sheet feeder (hereinafter, ASF) 132 by rotating a pickup roller 131 from a paper-feed motor 135 through a gear. Furthermore, the printing medium is transported (sub-scanned) through a position (printing section) opposed to an ejection surface of the head cartridge 100 by rotating a transport roller 109. The transport roller 109 is driven by rotating an LF motor 134 through a gear. In such a case, determining whether fed or not and establishing a leading edge upon paper feed are done when the printing medium 108 passes the paper end sensor 133. Meanwhile, the paper end sensor 133 is also used to finally determine where the leading edge of the printing medium 108 actually is and a current printing position from the actual tail edge.

The printing medium 108 at its back surface is supported by a platen (not shown), in order to form a flat printing surface in the printing zone. In this case, the head cartridge 100, mounted on the carriage 102, is held at its ejection surface protruding downward from the carriage 102 and placed in parallel with the printing medium 108 between two transport roller pairs.

The head cartridge 100 is mounted on the carriage such that the ejection opening arrays are in a direction different from the scanning direction of the carriage so that printing can be made by ejecting a liquid through the ejection opening arrays. Although the embodiment had the electro-thermo converter for generating thermal energy in order to eject ink by utilization of thermal energy, another scheme may be naturally applicable, e.g. ink ejection by piezoelectric elements.

As explained so far, the present invention can decrease the deterioration of image quality caused by an increase of printing apparatus size, manufacturing error (variation), etc., and provide an image with high resolution and high quality. As a result, it is possible to realize speeding up of one-pass and bi-directional printing, size reduction of the apparatus and high-resolution printing at the same time.

This application claims the benefit of Japanese Patent Application No. 2006-248624, filed Sep. 13, 2006, which is hereby incorporated by reference herein in its entirety.

What is claimed is:

1. A printing head structured to include ejection opening-array groups, which include a plurality of ejection opening arrays from which ink of a same color and of a same volume is ejected, for each color and volume of ink to be ejected, wherein the plurality of ejection opening-array groups include ejection opening-array groups of first and fifth arrangements from which inks of a first color are ejected, ejection opening-array groups of second and fourth arrangements from which inks of a second color are ejected, and an ejection opening-array group of a third arrangement from which ink of a third color is ejected, the ejection opening-array group of the first arrangement and the ejection opening-away group of the second arrangement are adjacent to each other, the volume (Va) of ink ejected from the ejection opening-array groups of the first arrangement and the volume (Va) of ink ejected from the ejection opening-array group of the second arrangement are substantially the same as each other, the ejection opening-array group of the fourth arrangement and the ejection opening-array group of the fifth arrangement are adjacent to each other, the volume (Vb) of ink ejected from the ejection opening-array groups group of the fourth arrangement and the volume (Vb) of ink ejected from the ejection opening-array groups group of the fifth arrangement are substantially the same as each other, and the volume (Va) is different from the volume (Vb).

2. A printing head as claimed in claim 1, wherein a pitch at which ejection openings are arranged in the ejection opening-array groups of the first and second arrangements is different from a pitch at which ejection openings are arranged in the ejection opening-array groups of the fourth and fifth arrangements, and the pitch of the ejection opening-array groups from which inks of small volume are ejected is smaller than the pitch of the ejection opening-array groups from which inks of large volume, which is larger than the small volume, are ejected.

3. An ink jet printing apparatus for performing printing by using a printing head, which is structured to include ejection opening-array groups, which include a plurality of ejection opening arrays from which inks of a same color and of a same volume are ejected, for each color and volume of ink to be ejected, to eject ink to a printing medium, said apparatus comprising:

print control means for executing printing operations of a plurality of print modes, wherein in one of the print modes, said print control means executes a printing operation in which only the ejection opening-array group from which ink of relatively small volume is ejected is used, of the plurality of ejection opening-array groups, the plurality of ejection opening-array groups include ejection opening-array groups of first and fifth arrangements from which inks of a first color are ejected, ejection opening-away groups of second and fourth arrangements from which inks of a second color are ejected, and an ejection opening-array group of a third arrangement from which ink of a third color is ejected, the ejection opening-array group of the first arrangement and the ejection opening-away group of the second arrangement are adjacent to each other, the volume (Va) of ink ejected from the ejection opening-array groups of the first arrangement and the volume (Va) of ink ejected from the ejection opening-array group of the second arrangement are substantially the same as each other, the ejection opening-array group of the fourth arrangement and the ejection opening-array group of the fifth arrangement are adjacent to each other, the volume (Vb) of ink ejected from the ejection opening-array group of the fourth arrangement and the volume (Vb) of ink ejected from the ejection opening-array group of the fifth arrangement are substantially the same as each other, and the volume (Va) is different from the volume (Vb).

4. An ink jet printing apparatus as claimed in claim 3, wherein an ejection drive frequency at which inks are ejected from the ejection opening-array groups of the first and second arrangements is different from an ejection drive frequency at which inks are ejected from the ejection opening-array groups of the fourth and fifth arrangements, and the ejection drive frequency of the ejection opening-array groups from which inks of small volume are ejected is greater than the ejection drive frequency of the ejection opening-array groups from which inks of large volume, which is larger than the small volume, are ejected.

5. An ink jet printing apparatus as claimed in claim 3, wherein, when a volume (Va) of ink ejected from the ejection opening-array group of the first or second arrangement is smaller than a volume (Vb) of ink ejected from the ejection opening-array group of the fourth or fifth arrangement in bidirectional printing, a number of dots formed on one pixel with inks ejected from the ejection opening-array group of the fourth or fifth arrangement is obtained by thinning a number of dots formed on one pixel with inks ejected from the ejection opening-array group of the first or second arrangement, and an amount of ink ejected to one pixel from the ejection opening-array group of the first or second arrangement is a same as an amount of ink ejected to one pixel from the ejection opening-array group of the fourth or fifth arrangement.

6. An ink jet printing apparatus as claimed in claim 3, wherein a pitch at which ejection openings are arranged in the ejection opening-array groups of the first and second arrangements is different from a pitch at which ejection openings are arranged in the ejection opening-array groups of the fourth and fifth arrangements, and the pitch of the ejection opening-array groups from which inks of small volume are ejected is smaller than the pitch of the ejection opening-array groups from which inks of large volume, which is larger than the small volume, are ejected.

* * * * *